United States Patent [19]

Lautenschlager, Jr. et al.

[11] 4,117,569

[45] Oct. 3, 1978

[54] OVER-CENTER KNUCKLE-JOINT HINGE

[75] Inventors: Karl Lautenschlager, Jr.; Reinhard Lautenschläger, both of Reinheim, Fed. Rep. of Germany

[73] Assignee: Karl Lautenschlager KG, Reinheim, Fed. Rep. of Germany

[21] Appl. No.: 740,980

[22] Filed: Nov. 11, 1976

[30] Foreign Application Priority Data

Nov. 25, 1975 [DE] Fed. Rep. of Germany ..... 2552729
Apr. 17, 1976 [DE] Fed. Rep. of Germany ..... 2617070

[51] Int. Cl.[2] ..... E05D 11/10
[52] U.S. Cl. ..... 16/139; 16/145; 16/163; 16/166
[58] Field of Search ..... 16/182, 183, 163, 164, 16/145, 139, 142, 166

[56] References Cited

U.S. PATENT DOCUMENTS

| | | | |
|---|---|---|---|
| 3,363,281 | 1/1968 | Borsani | 16/163 |
| 3,470,579 | 10/1969 | Cencioni | 16/166 |
| 3,991,437 | 11/1976 | Friedrichs et al. | 16/139 |

FOREIGN PATENT DOCUMENTS

| | | | |
|---|---|---|---|
| 2,502,774 | 7/1976 | Fed. Rep. of Germany | 16/139 |
| 676,348 | 11/1964 | Italy | 16/163 |
| 689,565 | 4/1965 | Italy | 16/164 |
| 716,257 | 10/1966 | Italy | 16/163 |
| 304,701 | 9/1968 | Sweden | 16/164 |
| 1,292,649 | 10/1972 | United Kingdom | 16/145 |

*Primary Examiner*—James Kee Chi

[57] ABSTRACT

A knuckle-joint over-center hinge, in combination with a first member for connection to a wall and a second member for connection to a door, and a first arm and a second arm, respectively, pivotaly linked to the first and second member, and an over-center mechanism forcing the hinge resiliently towards one of its end positions. The mechanism includes a closing spring having one end disposed and supported at the first arm which has a portion of U-shaped cross-section and a transverse wall. A pusher is displaceably mounted in the first arm, while the closing spring is disposed within the U-shaped portion and supports itself with its one end on the transverse wall, while the other end of the spring engages the pusher. The first member has a cam projection in the vicinity of the point where the first arm is pivotally linked to the first member, and the pusher supports itself on the cam projection.

6 Claims, 6 Drawing Figures

FIG. 4
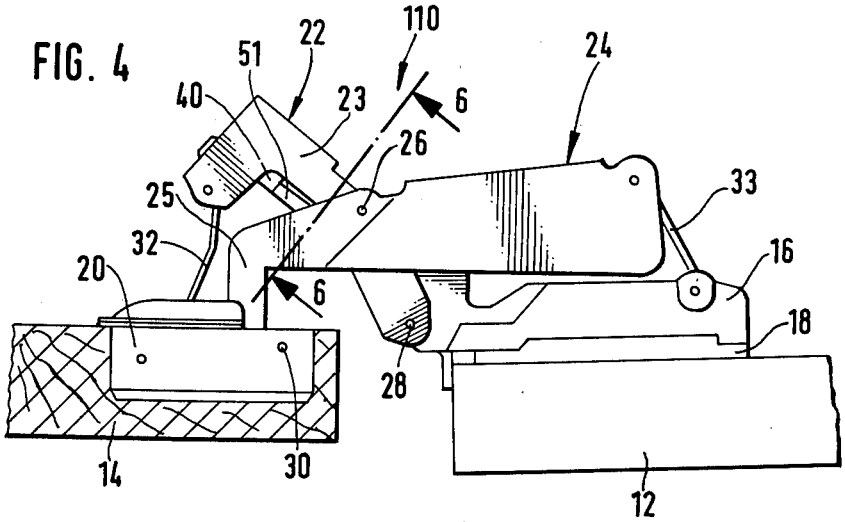
FIG. 5
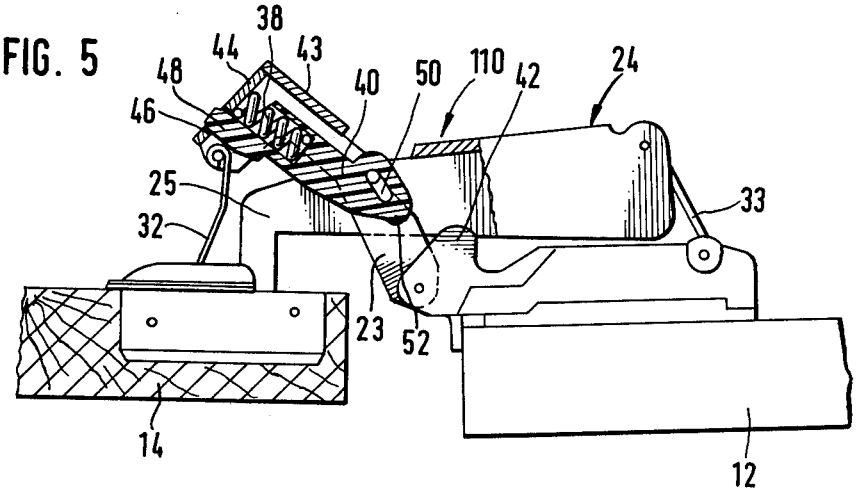
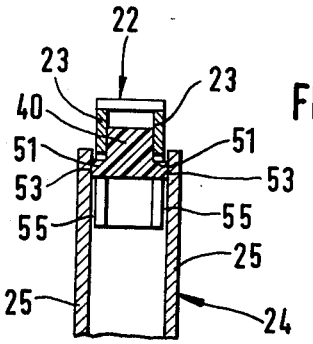
FIG. 6

OVER-CENTER KNUCKLE-JOINT HINGE

BACKGROUND

The invention relates to an over-center knuckle-joint hinge having a supporting-wall member and a door member which are joined to one another by a knuckle-joint mechanism formed by two arms coupled together in their central area, one of the extremities of the arms being articulated to the supporting-wall member in the one case and to the door member in the other, while the other end in each case is coupled to the other member either in a sliding guide or indirectly through a link, and having an over-center mechanism resiliently urging the hinge into the end position of the hinge, at least in the vicinity of the closed position, the closing spring of said over-center mechanism being disposed and supported at the arm linked to the supporting-wall member, while its second end is supported directly or indirectly against a counter-surface which during the hinge pivoting action changes its spatial position relative to this spring end from the one end position to the other such that the spring undergoes a maximum deflection in an intermediate position.

In a known knuckle-joint hinge (German Offenlegungsschrift No. 2,219,616), in which the arm articulated to the door member is coupled indirectly to the supporting-wall member through a link, a closing spring bent in a U-shape is so disposed on this link that its bend passes around the pivot pin which joins the link to the arm. One limb of the spring is supported against the link, while the other limb presses against a guiding path which is provided on the supporting-wall member and is so constructed that the desired closing action is achieved. Such a construction of the closing or over-center mechanism, however, is practical only in knuckle-joint hinges in which the above-mentioned link is present. In practice, however, knuckle-joint hinges are also frequently used in which the arm articulated to the door member is coupled directly to the supporting-wall member by a slide-like guide (e.g., German Pat. No. 1,958,983). In this case, a certain required movement of the hinge can be achieved most simply by providing an appropriate curve in the slide groove, and yet any over-center mechanism that might have to be provided has to be provided in the vicinity of the arms of the knuckle joint, and this is difficult, particularly on account of the little space that is available in the closed position of the hinge. In a hinge of the initially described kind which is provided with an over-center mechanish (German Offenlegungsschrift No. 2,323,412), the closing spring that is mounted on one of the arms is in the form of a curved leaf spring which cooperates with a roller disposed on a projection of a link connecting the arm to the door member. This design requires a relatively great amount of space, so that the arm holding the leaf spring, as well as the link provided with the roller, has undesirably great dimensions and therefore give the hinge a clumsy appearance.

THE INVENTION

The invention is addressed to the problem of devising an improved over-center mechanism for knuckle-joint hinges, which will be applicable both to the above-mentioned knuckle-joint hinges having slide guides on the supporting-wall member and to the link-coupled hinges. At the same time, the over-center mechanism must be of simple, space-saving construction, economical to manufacture and quick to install, while not impairing the sturdiness of the hinge, and even improving same.

Setting out from a hinge of the initially described kind, this problem is solved in accordance with the invention in that the closing spring is disposed within an area of U-shaped cross section of the arm, and one end of said spring is supported against a transverse wall of the arm, that the other end of the spring lies against a pusher which is mounted in the arm for displacement, at least within a certain distance, against the force of the spring, and that the supporting-wall member has in the vicinity of the supporting-wall bearing point of the arm a cam projection on which there is formed the counter-surface against which the pusher rests. The spring and the pusher can thus be disposed within the arm, which in any case is of U-shaped cross section for reasons of strength, and thus it does not require additional space.

The displaceable mounting of the pusher is achieved in further development of the invention by mounting the pusher displaceably at its one end on a pin-like projection passing through a hole in the transverse wall of the arm, and at its other end by means of an elongated hole through which the central pivot pin of the knuckle-joint mechanism passes.

In order to secure in its position within the arm the closing spring, which in this embodiment is preferably in the form of a helical spring under compressive bias, the pusher can be of such shape that it covers the space contained within the U-shaped portion of the arm, thereby concealing the closing spring in the said space.

To reduce the friction between the outside of the sidewalls of the inner arm and the inside of the sidewalls of the outer arm, which occurs when the cabinet door is opened, and which, on the one hand, causes a certain difficulty of operation, especially in the case of heavy doors on tall cabinets equipped with more than two such hinges, and on the other hand scratches the visible outside of the sidewalls of the inner arm in the course of time, provision is made in a further development of the invention for the pusher to be of such a size that it will be partially outside of the sidewalls of the arm receiving the spring, and for projections having substantially flat end faces to project from that section of the pusher that is located outside of the sidewalls in opposite directions towards the inside faces of the sidewalls of the other link overlapping the sidewalls of the first arm, the distance between the said flat end faces being equal approximately to the inside distance between the sidewalls of the second arm. Thus, in accordance with the invention, the pusher of the over-center mechanism will have an additional function as a friction-reducing bearing acting to reduce friction between the arms. It is to be noted that this friction-reducing function does not impair the over-center operation of the pusher, because the end faces of the projections of the pusher serving as bearing surfaces, as a result of the kinematics of the knuckle-joint hinge do not supportingly engage the inside faces of the sidewalls of the second or outer arm until the door has been opened by a certain amount, i.e., until the locking engagement of the pusher with its counter-surface has been disengaged. But in those door positions in which the arms are especially stressed by the weight of the door, the desired relieving of the load between the confronting faces of the sidewalls of the arms is achieved, so that it must be concluded, therefore, that the hinge in accordance with the invention is considerably improved in its operation merely by a slight modification of the shape of the pusher, without any additional manufacturing expense.

The invention will now be further explained with the aid of several embodiments, in conjunction with the drawings, wherein:

FIG. 4 is a top plan view of another embodiment of the knuckle-joint over-center hinge of the invention, in a position in which the door is opened ninety degrees from the closed position;

FIG. 5 is a partially cut-away view of the same mechanism represented in FIG. 4, and FIG. 6 represents a cross section taken along the line indicated by the arrows 6—6 of FIG. 4, as seen in the direction of the said arrows.

Figure 1:
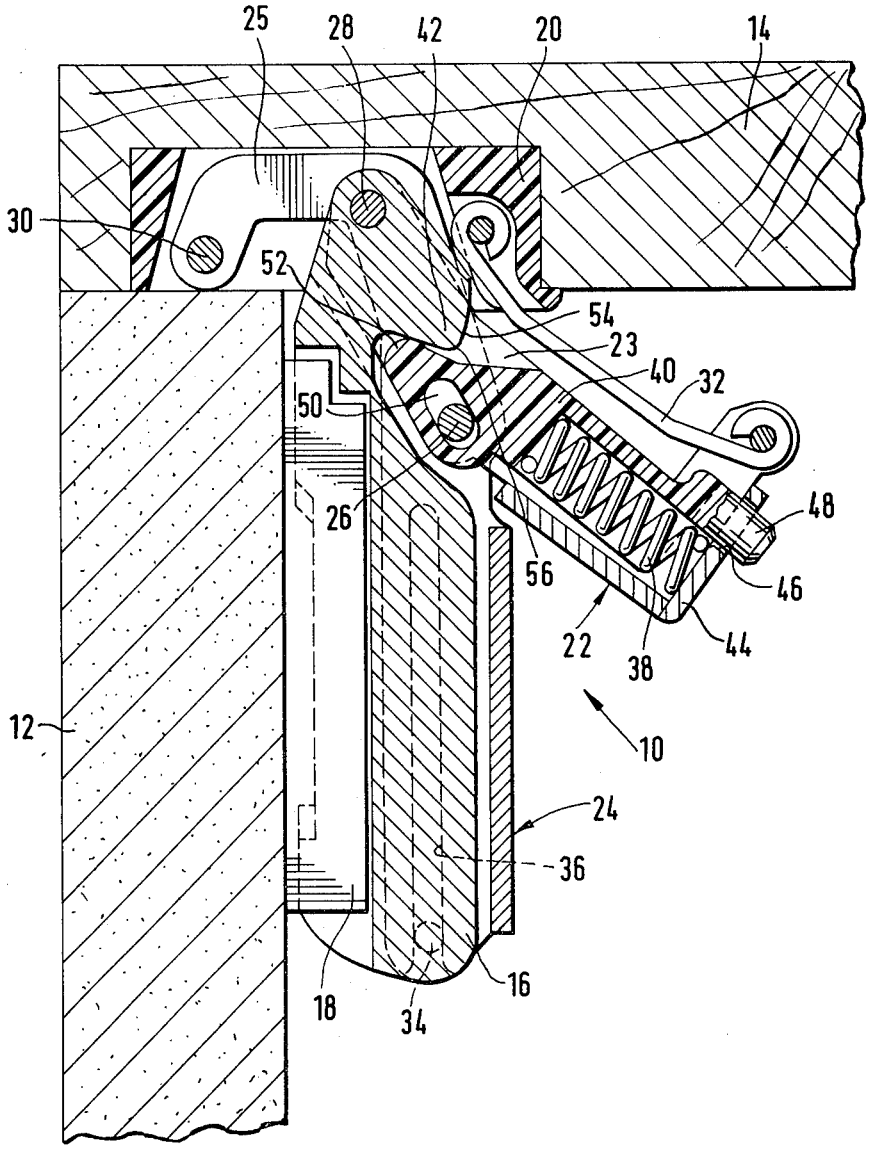
FIGS. 1 and 2 are top plan views, partially in cross section, of a knuckle-joint over-center hinge in accordance with the invention, in the closed and fully opened positions, respectively.
Figures 2, 3:
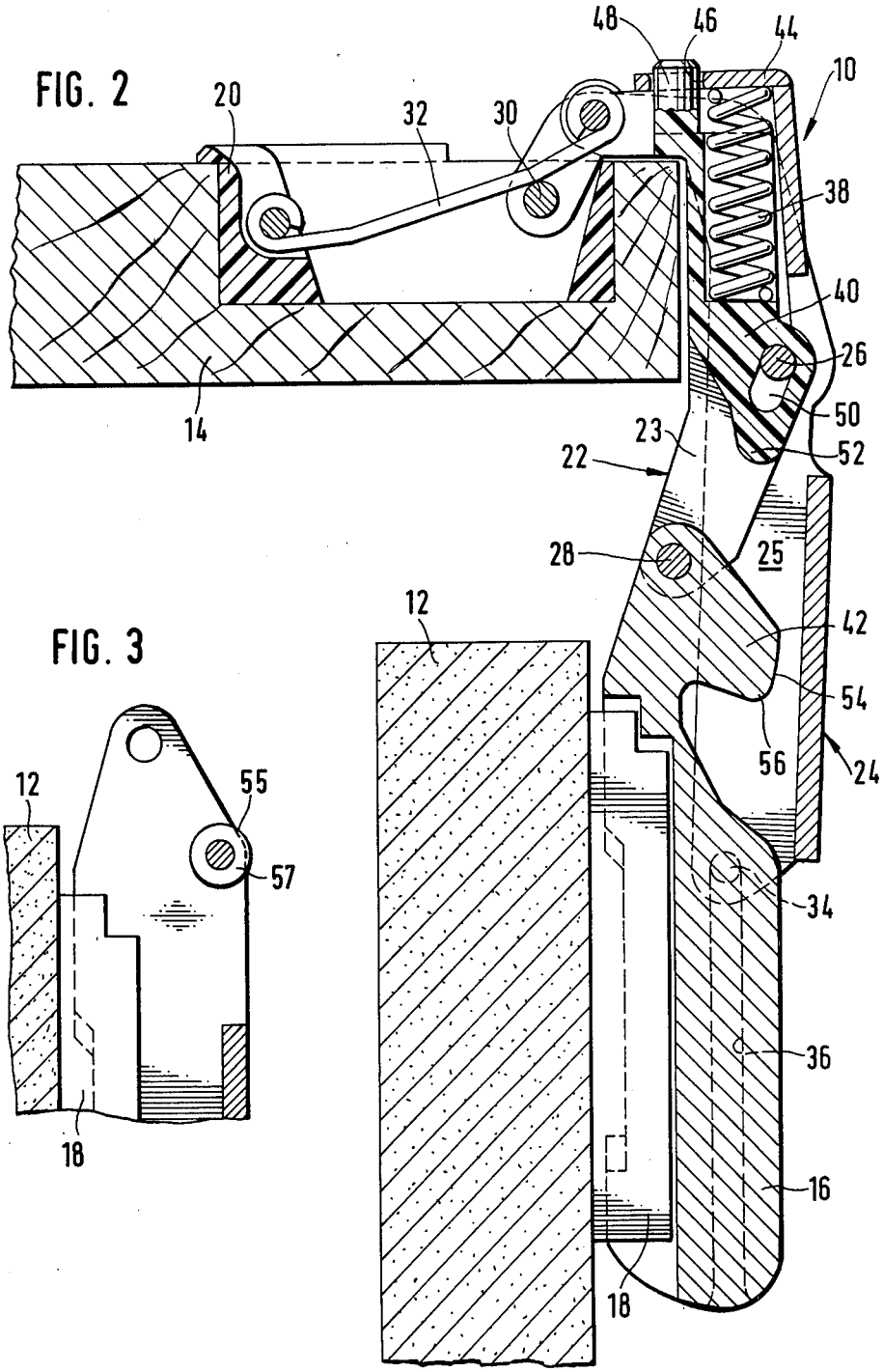
FIG. 3 is a detail of an over-center hinge of the invention, which is a modification of the one represented in FIGS. 1 and 2.

The first embodiment of a knuckle-joint hinge 10 in accordance with the invention, which is represented in FIGS. 1 and 2, serves to hang a door 14 on a supporting wall 12. The supporting-wall member 16 of the hinge is fastened to the supporting wall 12 in the conventional manner by means of a mounting plate 18. The door member 20 is in the likewise popular form of a recessed cup, made, as a rule, by injection molding from a plastic.

The knuckle-joint is formed by two arms 22 and 24, each having pairs of parallel sidewalls 23 and 25, respectively, which are pivotingly joined together in their middle portion by a pivot pin 26, the inner faces of the sidewalls 25 of arm 24 overlapping with slight clearance the outer faces of sidewalls 23 of arm 22. The arm 22 is pivotingly attached to the supporting-wall member 16 by means of a pivot pin 28, and the arm 24 is pivotingly attached to the door member 20 by means of a pivot pin 30.

To the other, swinging end of arm 22 there is pivotingly attached a link 32 whose other end is pivotingly mounted in the door member 20 and which guides this arm 22 on an arcuate path. On the other hand, the second end of arm 24 is guided slidingly directly by a frictional guiding means on the supporting-wall member 16. The frictional guiding means is formed by short, inwardly projecting guide pins 34 mounted on the inner sides of the arm 24 which in this end portion is of U-shaped cross section, the said pins engaging elongated outer slide grooves 36 in the supporting-wall member 16. The construction of the knuckle-joint hinge as described thus far is known.

The over-center mechanism of the invention is formed, in this embodiment, by a pusher 40 of plastic, which is longitudinally displaceable against the urging of a compressively biased helical spring, and which cooperates with a cam projection 42 formed on the supporting-wall hinge member 16 adjacent the pivot pin 28. The arm 22 is of U-shaped cross section in its outer lever-arm area containing the helical spring 38 and is L-shaped at the end, the L-shaped portion being closed off by a wall 44. In this wall 44 there is provided a bore 46 in which a pin-like projection 48 of pusher 40 is guided for longitudinal displacement. Furthermore the pusher is guided at its other end by an elongated hole 50 through which the pivot pin 26 passes.

As it can be seen in FIG. 1, the rounded end 52 of the pusher 40 engages the cam surface formed on the cam projection 42 when the hinge 10 is near the closed position, the said cam surface being so shaped that, when the door is swung from the closed position to the open position, the pusher is first forced back and the spring 38 is compressed, until the highest point 56 of the cam surface 54 is reached, which represents the hinge's dead center. As the door is swung further, the pusher slides forward on the cam surface, which is now receding again, and after a short pivoting movement comes free from the cam projection 42. The rest of the movement of the hinge to the open position is not influenced by the over-center mechanism. In this pivoting movement, that end of the elongated slot 50 of the pusher which is nearest the spring 38 is engaged with the pin 26, thus preventing the pusher and the spring from dropping out of the arm 22.

FIG. 3 illustrates a variant of the over-center mechanism described above, in which the frictional engagement and resultant wear occurring between the end 52 of pusher 40 and the cam surface 54 of the cam projection 42 in the embodiment shown in FIGS. 1 and 2 is eliminated. Instead of the cam surface 54, the circumferential surface 55 of a roller 57 mounted on the cam projection cooperates with the end of the pusher 40. Since the circumferential surface 55 of roller 57 rolls on the end 52 of the pusher, no sliding friction occurs at the points of contact between the cooperating parts, and not only is wear reduced, but also a more sensitive and spontaneous operation of the over-center mechanism is achieved when the dead center is passed.

In FIGS. 4 and 5 there is shown a hinge 110 which is largely the same as the hinge 10 described above in conjunction with FIGS. 1 and 2, insofar as the knuckle-joint over-center mechanism is concerned, and in which the second end of the arm 24 is coupled to the hinge member 16 by a link 33 rather than by the slide guiding means described above. Since the parts of hinge 110 which are the same as those in the previously described hinge 10 are provided with the same reference numbers, it will suffice to refer to the foregoing description with regard to the design and operation of the over-center mechanism.

However, the pusher 40 of the over-center mechanism has an additional function in hinge 110. In contrast to hinge 10, in which it is located substantially entirely between the sidewalls 23 of arm 22, i.e., is virtually invisible externally, a small portion of the pusher 40 emerges between the sidewalls in the case of hinge 110. On the lateral surfaces of this section of pusher 40 which lies outside of the sidewalls, projections 51 extending towards the inside faces of the sidewalls 25 of the other arm 24 are provided, which have flat end surfaces 53 (see FIGS. 4 and 6), the said projections 51 extending from the pusher by such an amount that their end surfaces 53 are about the same distance apart from one another as the inside distance between the sidewalls 25 of arm 24. When the door 14 is opened, the projections 51, which are at first exposed in the closed position, enter between the sidewalls 25 of the arm 24 and support the latter from the inside. Since the pusher 40 has a width in its area located within the sidewalls 23 of arm 22 which is the same as the gap between these sidewalls 23, but a gap 55 exists on both sides between the inside faces of sidewalls 25 and the outside faces of the sidewalls 23, as can easily be seen in FIG. 6, any stress acting on one of the arms 22 or 24 is transmitted to the other arm through the projections 51 of pusher 40 rather than directly. Direct metallic frictional contact between the arms is thus avoided at least in that portion of the movement of the hinge in which the projections 51 are engaged between the sidewalls 25.

We claim:

1. A knuckle-joint over-center hinge adapted to occupy two end positions offset by an angle of from 170° to 180° with respect to each other and a dead-center position, in combination with a first member for connection to a cabinet wall and a second member for connecting to a cabinet door, comprising: a first arm and a second arm, one end of said first arm being pivotally linked to said first member, and one end of said second arm being pivotally linked to said second member, the other end of said first arm being coupled to said second member so as to be variable as to position along a predetermined spatial curve, the other end of said second arm being coupled to said first member so as to be variable as to position along a predetermined spatial curve, and an over-center mechanism forcing said hinge resiliently towards one of said end positions, said mechanism including a closing spring having a first end disposed and supported at said first arm and a second end, a counter-surface which changes its spatial position relative to said second spring end during the pivoting movement of said hinge from one end position to the other end position such that the spring undergoes a maximum deflection in an intermediate position of said hinge, said first arm having a portion of U-shaped cross-section, and a transverse wall, a pusher displaceably mounted in said first arm, said closing spring being disposed within said portion of U-shaped cross-section and supporting itself with its said first end on said transverse wall, said second end of said spring engaging said pusher, said first member having a cam projection in the vicinity of the point where said first arm is pivotally linked to said first member, said counter-surface being formed on said cam projection, said pusher supporting itself on said counter-surface.

2. A hinge according to claim 1, comprising a rotatably mounted roller at said cam projection, the peripheral surface of said roller being engaged by said pusher at least in area of said dead-center position of said hinge.

3. A hinge according to claim 1, comprising: a bore in said transverse wall, a pin-like projection passing through said bore and being connected to said pusher, a slot in said pusher in an area remote from said projection, said mechanism having a pivot pin passing through said slot, said pusher being displaceably guided by said projection in said bore and by said pin in said slot.

4. A hinge according to claim 1, wherein said pusher is shaped such that it encloses said closing spring in said portion of U-shaped cross-section.

5. A hinge according to claim 1, wherein each of said first and second arms has two spaced side walls, the side walls of of said first arm passing through the side walls of said second arm, said pusher being dimensioned such that it lies partially outside the side walls of said first arm, said pusher having projections with substantially flat end faces and projecting from the portion of said pusher lying outside the side walls of said first arm and towards the side walls of said second arm, the distance between said end faces corresponding approximately to the distance between the facing surfaces of the side walls of said second arm.

6. A hinge according to claim 1, wherein said closing spring is a helical spring under compressive bias.

* * * * *